United States Patent [19]

Sidransky

[11] Patent Number: 4,613,291

[45] Date of Patent: Sep. 23, 1986

[54] INLET CONSTRUCTION FOR A SCROLL COMPRESSOR

[75] Inventor: Fred S. Sidransky, Rockford, Ill.

[73] Assignee: Sundstrand Corporation, Rockford, Ill.

[21] Appl. No.: 761,483

[22] Filed: Aug. 1, 1985

[51] Int. Cl.[4] ..... F01C 1/04; F04C 18/04

[52] U.S. Cl. ..... 418/15; 418/55; 418/59

[58] Field of Search ..... 418/15, 55, 59, 180

[56] References Cited

U.S. PATENT DOCUMENTS

| | | | |
|---|---|---|---|
| 1,527,807 | 2/1925 | Loguin . | |
| 2,475,247 | 7/1949 | Mikulasek . | |
| 2,494,100 | 1/1950 | Mikulasek . | |
| 3,600,114 | 8/1971 | Dvorak et al. | 418/55 |
| 3,989,422 | 11/1976 | Guttinger . | |
| 4,141,677 | 2/1979 | Weaver et al. . | |
| 4,157,234 | 6/1979 | Weaver et al. . | |
| 4,204,816 | 5/1980 | Bein | 418/55 |
| 4,357,132 | 11/1982 | Kousokabe | 418/55 |
| 4,365,941 | 12/1982 | Tojo et al. . | |
| 4,457,674 | 7/1984 | Kawano et al. . | |
| 4,457,676 | 7/1984 | Hiraga . | |
| 4,472,120 | 9/1984 | McCullough . | |
| 4,477,239 | 10/1984 | Yoshii et al. . | |
| 4,514,150 | 4/1985 | Hiraga et al. | 418/55 |
| 4,526,521 | 7/1985 | Sudbeck et al. | 418/55 |

FOREIGN PATENT DOCUMENTS

| | | | |
|---|---|---|---|
| 57-153984 | 9/1982 | Japan | 418/55 |

*Primary Examiner*—John J. Vrablik

*Attorney, Agent, or Firm*—Wood, Dalton, Phillips, Mason & Rowe

[57] ABSTRACT

Efficiency of a scroll type compressor or pump having interfitting, generally spiralled vanes is achieved by disposing passages in the outer wraps of the vanes in proximity to the radially outer ends of the vanes.

7 Claims, 2 Drawing Figures

INLET CONSTRUCTION FOR A SCROLL COMPRESSOR

FIELD OF THE INVENTION

This invention relates to an inlet construction for use in a scroll-type positive displacement apparatus, and more specifically, to a scroll type pump such as a compressor.

BACKGROUND OF THE INVENTION

Prior art of possible relevance includes the following U.S. Pat. Nos.: 1,527,807 issued Feb. 24, 1925 to Loguin; 2,475,247 and 2,494,100 respectively issued on July 5, 1949 and Jan. 10, 1950 to Mikulasek; 3,989,422 issued Nov. 2, 1976 to Guttinger; 4,141,677 and 4,157,234 respectively issued on Feb. 27, 1979 and June 5, 1979 to Weaver et al; 4,365,941 issued Dec. 28, 1982 to Tojo et al; 4,457,674 issued July 3, 1984 to Kawano; 4,457,676 issued July 3, 1984 to Hiraga; 4,472,120 issued Sept. 18, 1984 to McCullough; and 4,477,239 issued Oct. 16, 1984 to Yoshii.

Positive displacement apparatus of the scroll type have been proposed in a variety of configurations over several decades. Generally speaking, they may be divided into two different categories. In one classification are those wherein the scrolls are non-rotating but wherein one scroll orbits with respect to the other. In the second classification, there is relative orbiting between the scrolls and both rotate relatively synchronously as well.

In either type, but particularly the type of the latter category, where the apparatus is used as a pump such as a compressor, to maximize efficiency it is desirable to take maximum advantage of ram air pressure available at the inlet which typically is defined by the radially outer ends of the spiral-like vane employed in such apparatus.

It is also desirable to minimize the draft force being applied to the outer wraps of the vanes during operation which drag of course requires a higher energy input to maintain a given speed than would be necessary if the drag could be reduced.

The present invention is directed to overcoming one or more of the above problems.

SUMMARY OF THE INVENTION

It is the principal object of the invention to provide a new and improved positive displacement apparatus of the scroll type. More specifically, it is an object of the invention to provide a scroll type pump or compressor which minimizes the drag forces acting on the out wraps of the vane and which maximizes the utilization of ram air pressure at the inlet to increase pump efficiency.

An exemplary embodiment achieves the foregoing objects in a construction including first and second scrolls, each mounting at least one spiral-like vane, with each vane in turn having a radially outer wrap and a radially inner wrap. The scrolls are mounted for at least relative orbiting movement with the vanes in interfitting relation to define travelling fluid receiving pockets. A first port opens to the interface between the scrolls generally centrally thereof and a second port is at the interface of the scrolls at their radially outer wraps. A fluid passage extends through at least one of the vanes from the radially outer side of such vane to the radially inner side thereof and is located in proximity to one of the ports.

In a preferred embodiment, the second port is an inlet port and the fluid passage is located in the radially outer wrap adjacent the inlet port. Preferably, there are a plurality of such passages, at least one in each of the vanes in the outer wrap thereof.

In one embodiment, the passage may be in the form of a nozzle.

In a highly preferred embodiment of the invention, the scrolls are mounted for substantially synchronous rotating movement as well as relative orbiting movement.

According to the invention, the passages act to prevent excess boundry layer development at the outer wraps of the device thereby reducing the drag on the same. They also act to prevent premature separation of the fluid surrounding the outer wrap in the vicinity of the radially outer ends of the outer wrap which act as the inlet and thus improve ram recovery of fluid at the inlet.

The invention also contemplates that passages may act as additional inlets allowing fluid to flow into the radially outer pocket through the passage as well as through the usual inlet thereby providing a greater mass of fluid in the pocket for ultimate compression by the apparatus.

Other objects and advantages will become apparent from the following specification taken in connection with the accompanying drawings.

DESCRIPTION OF THE PREFERRED EMBODIMENT

Figure 1:
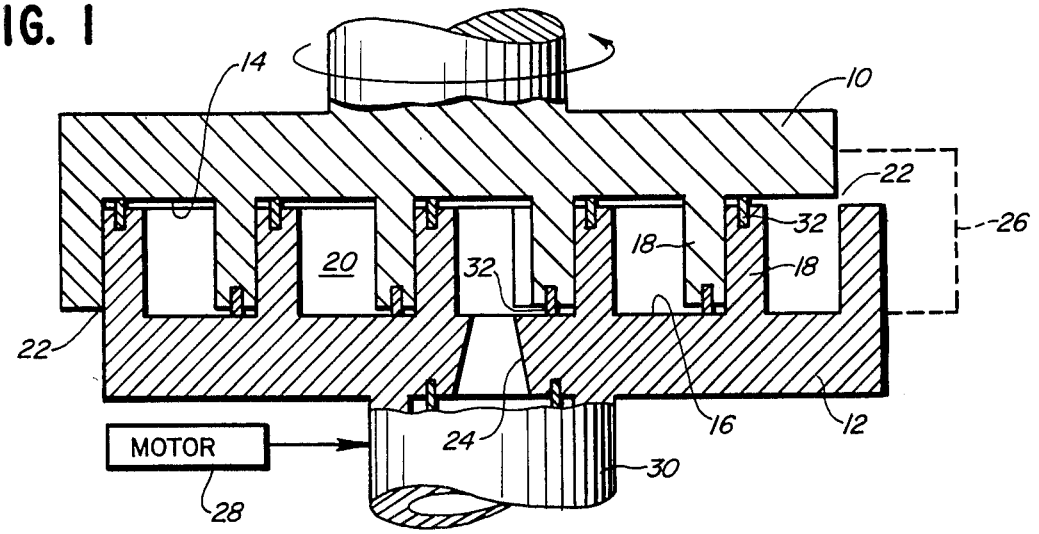
FIG. 1 is a somewhat schematic, sectional view of a scroll type apparatus made according to the invention.

An exemplary embodiment of a positive displacement scroll apparatus made according to the invention is illustrated in FIG. 1 and is in the form of a scroll compressor of the type wherein both scrolls are rotated, with each scroll in addition being translated or orbited in a rotary fashion relative to the other. However, it will be appreciated by those skilled in the art that the invention is not limited to a positive displacement of the type wherein both scrolls are rotated but may be used with efficacy in that sort of apparatus where the scrolls undergo relative orbiting without rotary motion. Furthermore, it will be appreciated that the invention may be utilized with efficacy in positive displacement machines operating as a pump.

The scroll compressor includes first and second scroll plates 10 respectively having faces 14 and 16. The faces 14 and 16 are generally parallel and each mounts at least one spiral-like vane 18. The vanes 18 on the scroll plates 10 and 12 interfit to define an interface between the two which, as is well known, includes a plurality of fluid receiving, travelling pockets 20 in which the fluid to be acted upon is received. The pockets 20, as is well known, move between radially inner positions and radially outer positions. When the apparatus is used as a compressor or a pump, a point 22 at the peripheries of the scrolls 10 and 12 at the interface of the same opens to define an inlet. In fact, there will be a number of the points 22 corresposding to the number of the vanes 18 employed in the apparatus and the location of the points 22 will move somewhat during operation of the device.

Generally centrally of the scroll 12 is an opening 24 which defines an outlet and in the case of the apparatus acting as a pump or a compressor, the pockets 20 move radially inwardly from the inlet 22 to the outlet 24. To achieve this, the vanes 18 are conventionally formed according to, for example, the teachings of the previously identified patents with the addition of the structure of the present invention as will be described. Means 26, shown schematically, of conventional configuration are utilized to connect the scroll plates 10 and 12 such that when the scroll 12 is rotated as by a motor 28 driving a shaft 30, the scroll 10 will rotate therewith about an axis provided by a shaft 31 connected thereto which will be parallel to but offset from the axis of rotation of the shaft 30.

To prevent leakage during operation, the vanes 18 may be provided with tip seals as are shown at 32. The shaft 30 may be hollow and in fluid communication with the overall outlet of the apparatus by any suitable conventional means.

Figure 2:
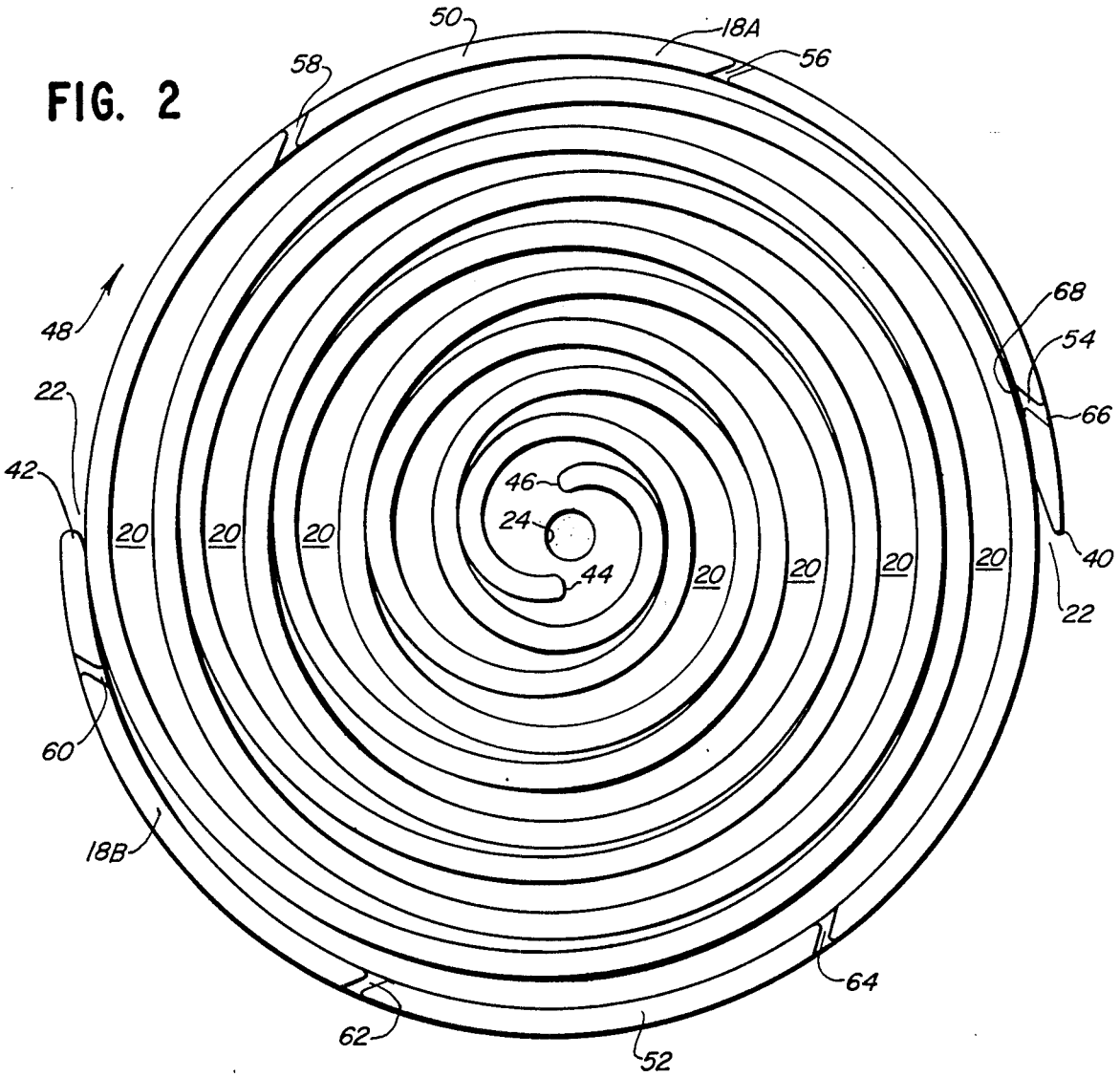
FIG. 2 is a view of interfitting vanes provided with an inlet structure made according to the invention and employed in a scroll type apparatus.

Turning now to FIG. 2, the vane 18 associated with the scroll plate 10 is designated 18*a* and the vane associated with the scroll plate 12 is designated 18*b*. Each of the vanes 18*a* and 18*b* has a radially outer end 40 and 42 respectively as well as a radially inner end 44 and 46 respectively. The ends 44 and 46 are in proximity to the outlet 24.

It will also be observed that each of the vanes 18*a* and 18*b* have a plurality of wraps, in the embodiment illustrated, five wraps each. As employed herein, the term "wrap" is intended to mean the convolutions of spiral form having an angular extent of 360°.

The radially outer ends 40 and 42 of the vanes 18*a* and 18*b* are somewhat pointed or provided with noses as illustrated in FIG. 2 and essentially define the inlet point 22 during operation of the apparatus. While as shown in FIG. 2, the vanes 18*a* and 18*b*, very closely adjacent the radially outer ends 40 and 42 are sealed to each other, relative orbiting of one scroll plate 10 with respect to the scroll plate 12 as both scroll plates rotate will change that relation and open pockets. The nose configuration of the ends 40 and 42 of the vanes 18*a* and 18*b* enhances entry of inlet fluid into such pockets as the scrolls rotate in the direction of an arrow 48.

According to the invention, the outer wrap 50 of the vane 18*a* and the outer wrap 52 of the vane 18*b* are each provided with at least one through passage. According to the embodiment illustrated in FIG. 2, the outer wrap 50 is provided with three such passages shown at 54, 56 and 58. The outer wrap 52 is similarly provided with three such passages shown at 60, 62 and 64. The passages 54–64 may be identical or somewhat different but according to the preferred embodiment are non-radial. In particular, and with reference to the passage 54 as being representative of all passages, the same has an opening 66 on the radially outer side of the outer wrap 50 as well as an opening 68 on the radially inner surface of the outer wrap 50. Furthermore, the opening 66 is in advance circumferentially of the opening 68 in the direction of rotation of the scroll plates 10 and 12. Desirably, one or the other or both of the openings 66 and 68 may have a nozzle-like configuration as illustrated in FIG. 2. The non-radial configuration just described provides an advantage of providing ram air or fluid to the radially outermost pocket during operation of the device. This, of course, increases the volumetric efficiency of the apparatus when used as a compressor or a pump.

Perhaps even more importantly, the passages 54–64 tend to bleed off the boundry layer that is present on the radially outer sides of the outer wraps 50 and 52 during operation of the device. Such bleeding is to the interior of the apparatus, specifically, the pocket which is in fluid communication with the corresponding passage. This has a two-fold effect. Firstly, because the bleeding off of the boundry layer will be continuous during operation of the apparatus and efficiency of the apparatus from the standpoint of energy consumption is increased. Secondly, the bleeding off of the boundry layer into the interior of the apparatus has a tendency to keep air on the outer surfaces of the outer wraps in relatively close adjacency thereto so that it may be readily picked up by the nose ends 40 and 42 of the vanes 18*a* and 18*b* during apparatus operation. Stated another way, this feature of the invention prevents the air stream external to the apparatus from separating from the scroll in the vicinity of the inlet areas defined by the ends 40 and 42 which would result in a decrease in volumetric efficiency.

The size of the passages 54–64 may be varied according to desired utilization of the apparatus. Where maximization of ram air intake through the passages 54–64 is desired, the passages will have relatively large cross-section. Conversely, and most usually, the boundry layer control is of the greatest significance, relatively small cross-sectional areas will be employed in forming the passages 54–64.

From the foregoing, it will be appreciated that a scroll type positive displacement apparatus according to the invention, simply by the formation of one or more passages in the outer wraps of the vane, is capable of providing an increase in the overall efficiency of the apparatus. The efficiency increase is achieved by minimizing drag on the outer wrap and by increasing the ram air input to the apparatus by allowing ram air input through the passages and/or controlling the fluid layer of the outer wraps in such a way as to be readily picked up by the ends of the vanes defining the inlets to the travelling pockets of the apparatus.

I claim:

1. A compressor comprising:

first and second scrolls each having a generally spiral-like vane having radially inner and outer ends and a plurality of wraps therebetween, the vanes on said scrolls interfitting to define a plurality of traveling pockets in which a fluid to be compressed may be received;

a central fluid outlet in at least one of said scrolls adjacent the radially inner ends of said vanes;

the radially outer ends of said vanes serving as an inlet to said compressor;

means mounting one of said scrolls for orbiting movement with respect to the other such that said pockets travel from said inlet to said outlets;

means for orbiting said one scroll; and at least one fluid through passage in each of said vanes in the outermost wrap thereof in relative proximity to the corresponding radially outer end and extending between the radially outer and radially inner surfaces of the associated vane.

2. The compressor of claim 1 wherein said mounting means further mounts both said scrolls for rotating movement and said orbiting means additionally rotates said scrolls in a substantially synchronous fashion.

3. The compressor of claim 2 wherein said passages have a first end on the radially outer surface of the associated vane and a second end on the radially inner surface of the associated vane, and said first ends are located circumferentially in advance of said second ends in the direction of rotation of said scrolls.

4. A positive displacement apparatus comprising:

first and second scroll plates, each mounting at least one spiral-like vane, each in turn having a radially outer wrap and a radially inner wrap;

said plates being mounted in facing relation for simultaneous rotation and relative orbiting movement with the vanes in interfitting relation to define travelling fluid receiving pockets;

a first port opening to the interface between said plates generally centrally thereof;

a second port at the interface of said vanes at their radially outer wraps; and a fluid passage extending through each of said vanes from the radially outer side of said one vane to the radially inner side of said one vane and located in proximity to one of said ports.

5. The positive displacement apparatus of claim 4 wherein said fluid passage is in proximity to said second port.

6. A compressor comprising:

first and second scroll plates in facing relation and each mounted on an associated rotary shaft;

means for rotating one of said shafts;

means interconnecting said plates so that both undergo rotation upon rotation of said one shaft and such that one plate orbits relative to the other;

interfitting spiral like vanes on said plates defining a plurality of travelling pockets adapted to receive a fluid to be compressed, each of the vanes having a plurality of wraps; and at least one passage extending through the radially outermost wrap of each of said vanes and extending between the radially outer and radially inner surfaces of the associated vane.

7. The compressor of claim 6 wherein said passage is a nozzle.

* * * * *